United States Patent [19]

Haslau et al.

[11] 3,976,256

[45] Aug. 24, 1976

[54] AUTOMATIC COIL WINDING MACHINE AND METHOD

[75] Inventors: Horst Eugen Haslau; Glenn Arvid Mattson, both of Indianapolis, Ind.

[73] Assignee: RCA Corporation, New York, N.Y.

[22] Filed: Jan. 28, 1975

[21] Appl. No.: 544,701

[52] U.S. Cl. ..... 242/4 B; 242/4 C

[51] Int. Cl.[2] ..... H01F 41/08

[58] Field of Search ..... 242/7.03, 4 B, 4 BE, 242/4 C, 4 R, DIG. 1; 269/63

[56] References Cited

UNITED STATES PATENTS

| | | | |
|---|---|---|---|
| 1,879,882 | 9/1932 | Pullets | 242/4 BE |
| 2,957,634 | 10/1960 | King | 242/4 B |
| 3,166,104 | 1/1965 | Foley | 242/DIG. 1 |
| 3,383,059 | 5/1968 | Fahrbach | 242/4 C |
| 3,559,899 | 2/1971 | Fahrbach | 242/4 B |
| 3,799,462 | 3/1974 | Fahrbach | 242/4 B |
| 3,877,652 | 9/1975 | Berngy | 242/4 C |

*Primary Examiner*—Edward J. McCarthy
*Attorney, Agent, or Firm*—Edward J. Norton; William Squire

[57] ABSTRACT

An automatic coil winding machine for winding a toroidal coil for a television picture tube deflection yoke includes a plurality of core clamps and corresponding linkages, providing both the operation of the core clamping action and the automatic raising and lowering of selected clamps in accordance with a predetermined program to prevent interference between any of the clamps with the coil winding machine and the coil winding process.

14 Claims, 7 Drawing Figures

AUTOMATIC COIL WINDING MACHINE AND METHOD

BACKGROUND OF THE INVENTION

1. Field of Invention

The present invention relates to an apparatus and method for winding a coil about a core such as a television picture tube deflection yoke core.

2. Description of the Prior Art

Prior art toroidal coil winding machines, for example, are of the type described in co-pending application Ser. No. 503,681 filed Sept. 6, 1974, invented by Haslau et al. and assigned to the assignee of the present invention, which application is a continuation of Ser. No. 278,351 filed Aug. 7, 1972, now abandoned. In the co-pending application, a coil winding machine is described in which a clamp is provided for clamping a television picture tube deflection yoke core. The clamp described, while an improvement over prior art clamps, is cumbersome in that a number of manual steps need to be performed by an operator in clamping and unclamping the core as a coil is being wound thereon. The clamping and unclamping steps require the immediate attention of an operator as the machine approaches certain coil winding positions. These positions, in particular, are those locations in the winding process in which the clamp can mechanically interfere with the shuttle and magazine. To provide for these difficulties, the prior art machines typically include a plurality of clamps which an operator manually engages or disengages from the core whenever the machine during the winding process causes the clamp, shuttle, magazine and machine frame to approach each other. However, such a process is cumbersome and slow for certain machine cycles in which the machine rapidly rotates the deflection yoke core.

SUMMARY OF THE INVENTION

A coil winding machine includes provision for the automatic clamping of a hollow core in accordance with the angular position of each of a plurality of core clamps. The core clamps are constructed and operated so that the machine can automatically unclamp a selected clamp and retract the clamp from a clamping position to a standby position. Any of a plurality of clamps for securing the core can, in a fully automatic manner, be clamped or unclamped and retracted as the respective clamps approach and pass through an interfering position with the machine.

A method as provided including the steps of winding a toroidal coil about a core while at the same time automatically operating a plurality of clamps to individually clamp and unclamp the core in accordance with the determined position of the core relative to the particular clamp clamping a given portion of the core approaching a preselected machine position, the clamp is automatically unclamped from the core and placed in a noninterfering or standby condition.

IN THE DRAWINGS

DETAILED DESCRIPTION

Figure 1:
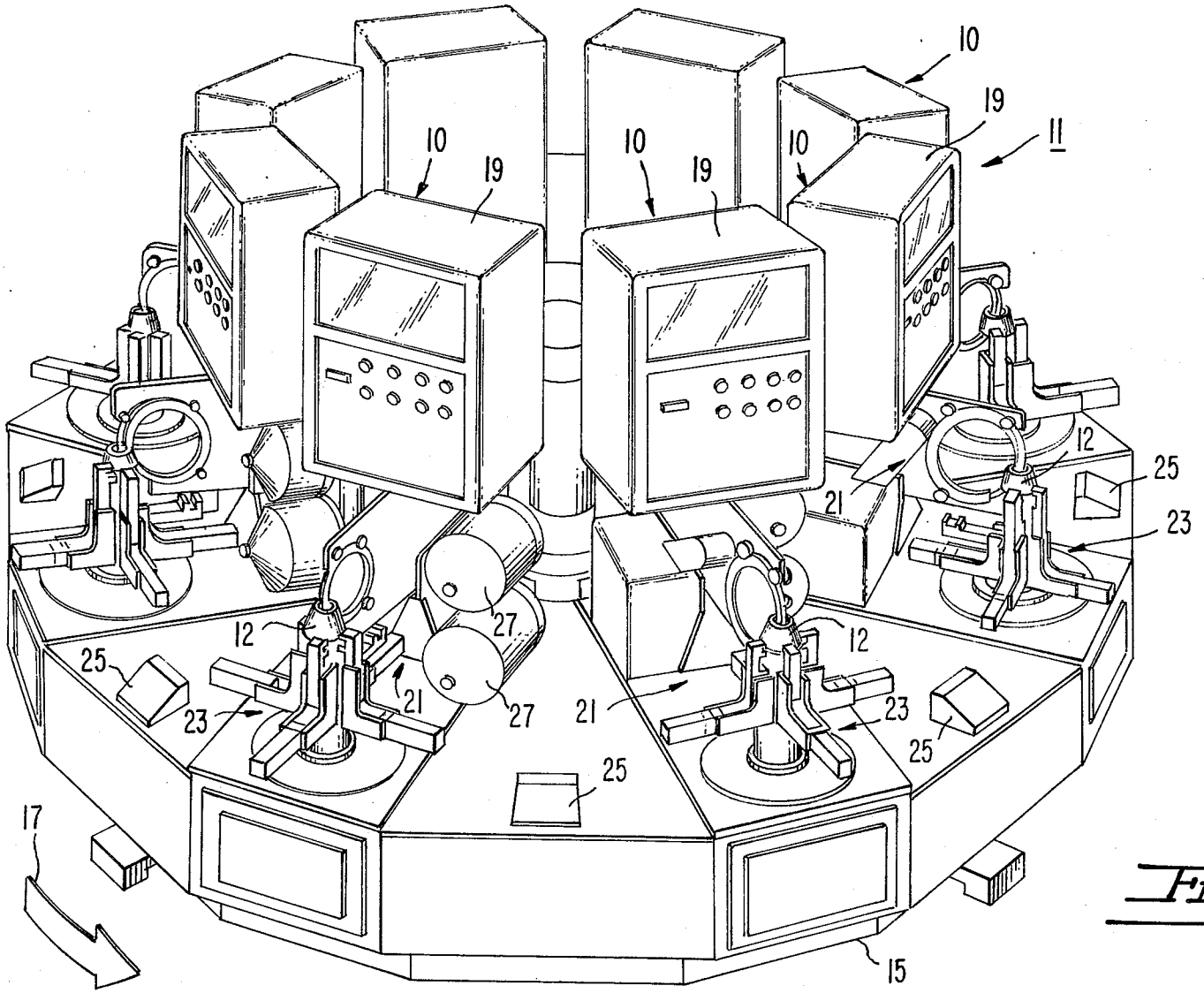
FIG. 1 is an isometric view of an automatic machine constructed in accordance with an embodiment of the invention.

In FIG. 1, apparatus 11 comprises a plurality of automatic toroidal coil winding machines 10 for winding toroidal coils about a corresponding plurality of television picture tube deflection yoke cores 12. Machines 10 are mounted on a turntable 15 which rotates in the direction 17. Machines 10 each comprise an automatic tape control and electronics portion 19 and a coil winding assembly 21. Coil winding assembly 21 includes a core clamping section 23 provided in accordance with the present invention which will be described in greater detail.

Each section 23 automatically clamps and unclamps a corresponding core 12 as that section 23 rotates independently of the other sections 23 during the toroidal coil winding process. Generally, machine 10 is of the type described in the aforementioned co-pending application. More specific details as to the construction of machine 10 are given in the above-noted co-pending application and will not be included herein.

Each machine 10 winds a coil on the corresponding core 12 independently of each of the remaining machines 10. A tape control in the electronic portion 19 of each machine is fully independent of the electronics portions 19 of the remaining machines so that each machine may wind the same or different types of toroidal coils on the corresponding core 12. Each machine 10 has its own corresponding control panel 25 which is connected to the various start-stop related controls for operating that coil winding machine associated therewith. These controls are conventional.

Each control panel 25 also includes suitable controls for stopping and starting the rotation of turntable 15. The mechanism for driving the turntable 15 and the associated coil winding machines 10 is conventional. Each machine 10 also includes its own filament supply 27 for the coil to be wound by that machine. As a result, an operator can stand in one position and merely load the cores 12 on the respective core clamping sections 23 or unload completed coils on wound cores 12 as they are finished. The apparatus 11 when rotating in the direction 17 positions completed coils in front of the operator who merely removes the coil wound core from the associated machine 10 and replaces the completed coil with a new core 12 on the core clamping section 23 of that machine. The electronic portion 19 of each machine 10 includes a continuous closed loop program tape-type control mechanism. Typically, a punched tape is used. The tape in portion 19 carries complete information for winding an entire television picture tube deflection yoke toroidal coil.

Figure 2:
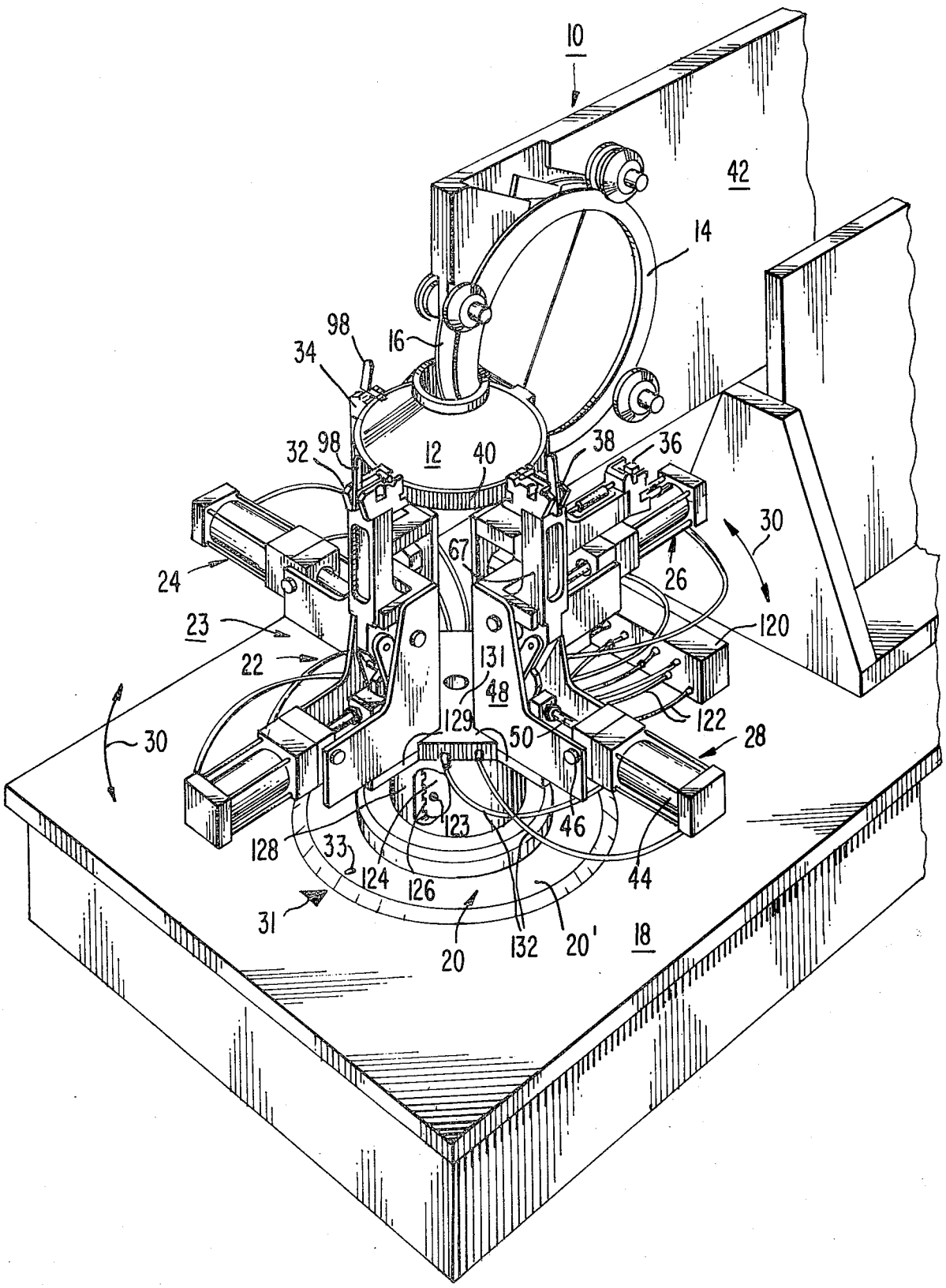
FIG. 2 is an isometric view of one of the coil winding machines shown in FIG. 1.

Reference will now be made to FIG. 2 which illustrates in greater detail a typical machine 10 and the corresponding core clamping section 23. In FIG. 2, coil winding machine 10 is arranged to wind a toroidal coil about a deflection yoke core 12 by means of a magazine 14 and shuttle 16 in a manner described in the aforementioned co-pending application. The machine 10 includes a base 18 on which is mounted a rotatably indexing head 20. Indexing head 20 comprises a flange 20′ and an upstanding cylindrical clamp assembly support head 124. Flange 20′ and head 124 are an integral unit connected to suitable drive means shown in the aforementioned co-pending application. Table 131 is secured to the upper end of head 124. Table 131 includes four radially outwardly extending slotted supports 129. Secured to indexing head 20 via table 131 and supports 129 are four substantially identical clamping assemblies 22, 24, 26 and 28.

Figures 3, 5:
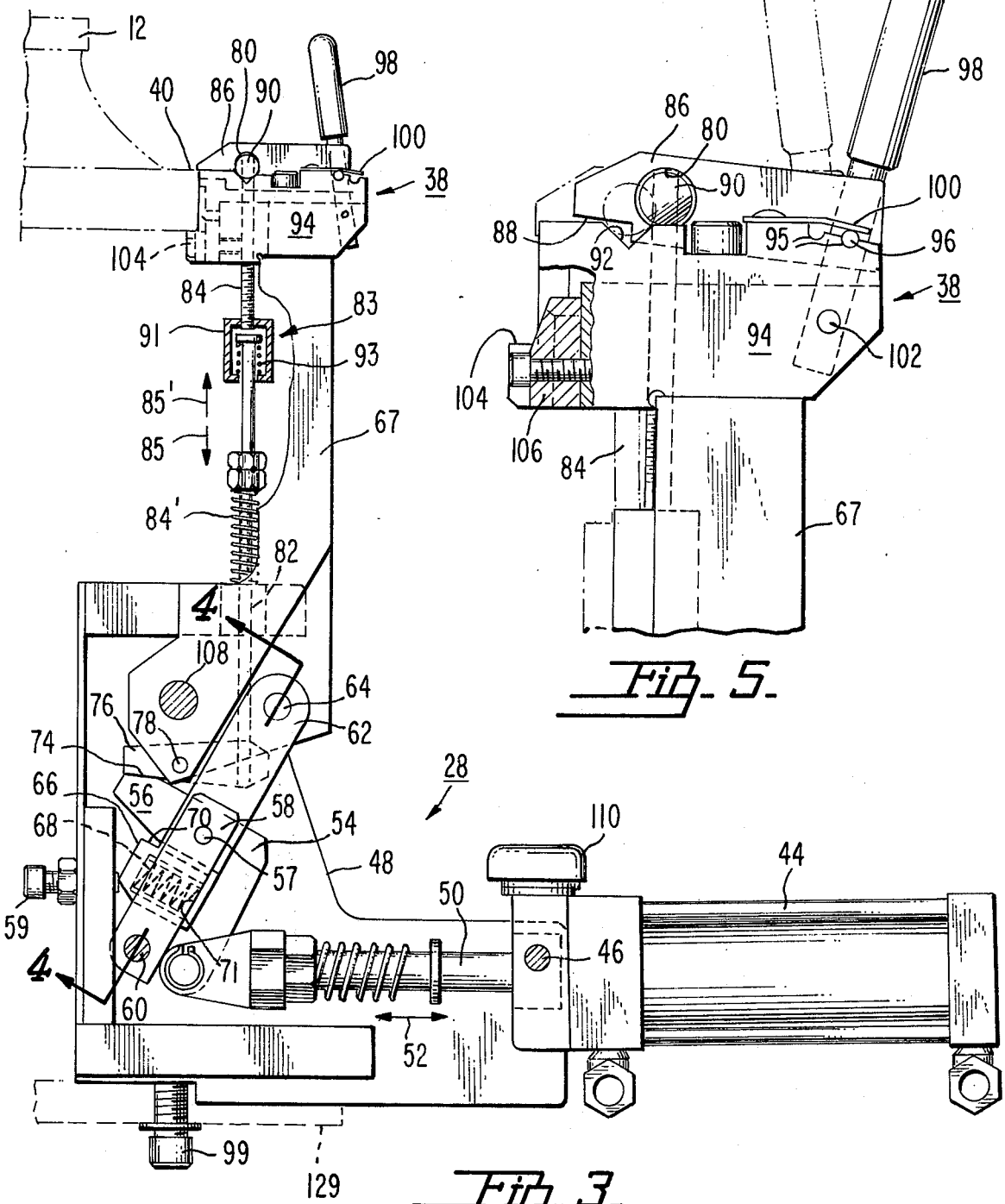
FIG. 3 is an elevational partial cutaway view of a clamping assembly in an upright position.
FIG. 5 is an enlarged elevation view of the clamp of FIG. 3.

Indexing head 20 is arranged to rotate in the azimuth or transverse direction 30 with respect to base 18. The clamping assemblies 22, 24, 26, 28 being secured to the indexing head 20 also rotate in the azimuth direction 30. Assemblies 22, 24, 26, 28 include corresponding core clamps 32, 34, 36 and 38, respectively. Each of the clamps 32, 34, 36, 38 clamp the outer peripheral edge of lower rim 40 of core 12 as best seen in FIG. 3. It will be appreciated that, as the clamping assemblies 22, 24, 26, 28 when in the clamping position rotate in direction 30, a portion of the clamping assembly structure may strike the frame or extended arm 42, magazine 14, shuttle 16 or other interfering parts of the machine 10 unless otherwise provided for.

As provided in accordance with the present invention, separate ones of the clamping assemblies 22, 24, 26, 28 are disengaged by first automatically releasing and unclamping the core clamps 32, 34, 36, 38, as the case may be, and then automatically lowering the interfering portion of the clamping assembly to a non-interfering prone position as illustrated by clamping assembly 26. In this position the lowered core clamp 36 of assembly 26 passes beneath the extended arm 42 of the machine 10 which arm serves as a support for the shuttle 16 and magazine 14.

The mechanism by which each of the clamping assemblies 22, 24, 26, 28 are released from the core 12 and lowered or raised and reclamped will now be described. Each of the clamping assemblies 22, 24, 26, 28 are substantially identical, and, therefore, a description of a typical assembly 28 will be made herein.

Figure 7:
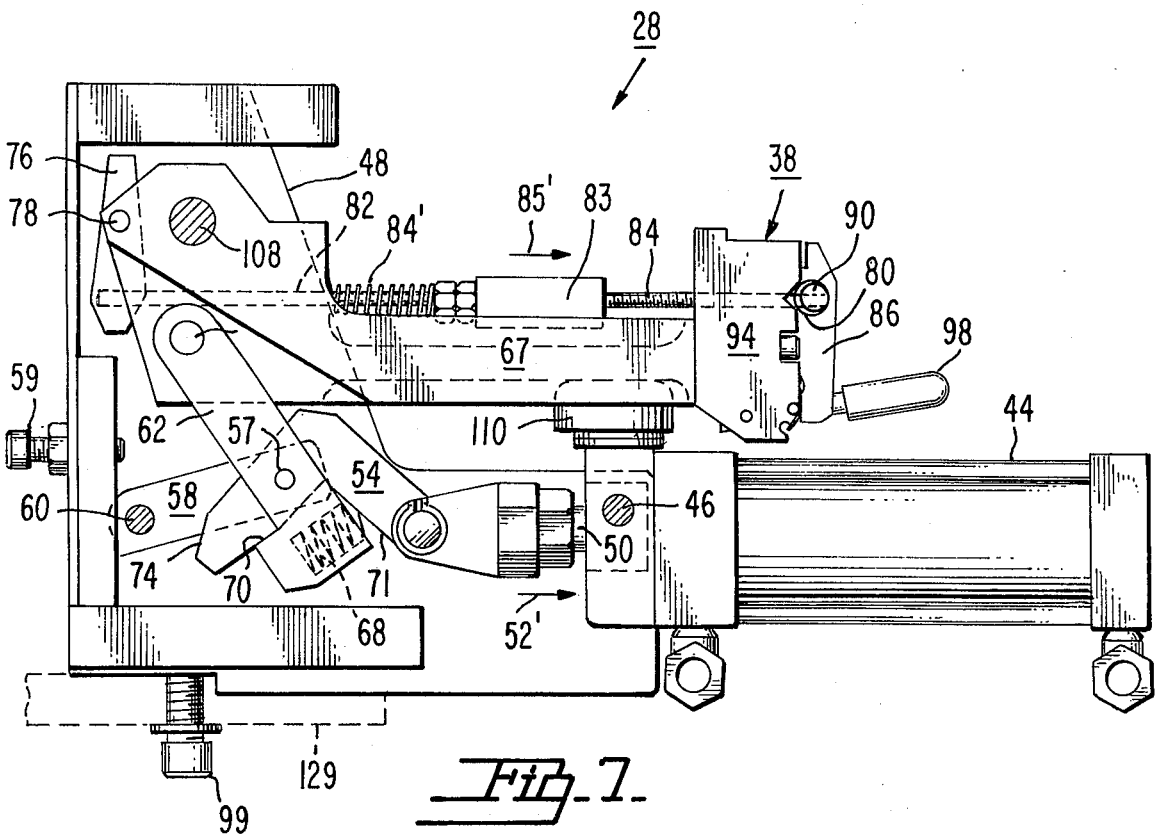
FIG. 7 is an elevation cutaway view of the clamping assembly of FIG. 3 in a lowered position.
Figure 4:
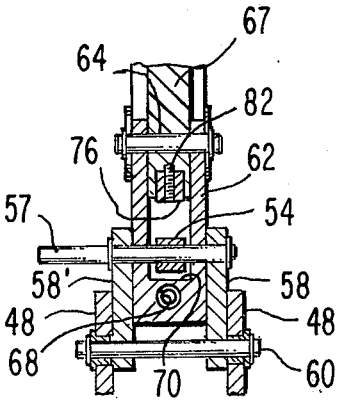
FIG. 4 is a sectional view taken along line 4—4 of FIG. 3.

In describing assembly 28, reference is first made to FIG. 3. Assembly 28 includes an air operated cylinder 44 pivotally mounted at pivot pin 46 to the clamping assembly frame 48 which is a hollow, channel-like L-shaped member which is mounted on table 131 and a corresponding support member 129. The cylinder 44 actuating shaft 50 reciprocates in the direction 52. Pivotally mounted to the protruding end of shaft 50 is bell crank 54. The end of one leg of crank 54 is pivotally mounted to shaft 50, while the other leg 56, at approximately midpoint, is pivotally mounted at pin 57 to link elongated rotating levers 58 and 58′ (FIG. 4). Levers 58 and 58′ are pivotally mounted at pin 60 to frame 48 on respective opposite sides of bell crank 54. Pivotally mounted between levers 58 and 58′ and around crank 54 at pin 57 is L-shaped yoke lever 62. Lever 62 is pivotally mounted at pin 64 to core clamp support arm 67. An end portion 66 forms one leg of lever 62 in which portion is disposed a compression spring 68 which abuts crank 54. End portion 66 abuts adjustable stop 59. A surface 70 of portion 66 abuts with a mating surface of bell crank 54 in the unclamp position (FIG. 7). Compression spring 68 exerts compressive forces between portion 66 and crank 54 resiliently locking bell crank 54 to portion 66 at surface 70 in the unclamp position. Surface 71 of crank 54 abuts with lever 62 when clamp 38 is in the clamped state as will be described. Otherwise, surface 71 is spaced from lever 62 as seen in FIG. 7.

Leg 56 of bell crank 54 has an upper cam surface 74. Cam surface 74 abuts with an adjacent cam surface disposed at one end of cam lever 76. Lever 76 is pivotally mounted at pin 78 at the lower end of clamp support arm 67. The other end of cam lever 76 is threaded to one end of a lower actuating rod 82. The upper other end of rod 82 is resiliently connected to the lower end of upper actuating rod 84 by suitable connecting means 83. Connecting means 83 includes a housing 91 to which rod 84 is threaded. Housing 91 slideably receives rod 82 therein. A coil spring 93 resiliently secures rod 82 to housing 91. When rod 82 is pulled in the downward direction 85 by cam 76, rod 82 engages spring 93 which in turn resiliently engages housing 91. Housing 91 in turn pulls rod 84 in direction 85. Spring 93 absorbs any downward shocks introduced by the action of cylinder 44. When rod 82 is urged in the upward direction 85′, the upper end of rod 82 directly engages the lower end of rod 84 or housing 91 as the case may be. In this instance rods 82 and 84 act as a single integral push rod.

Rod 82 is also secured resiliently in the direction 85 and 85′ by spring 84′ coupled between arm 67 and suitable nuts secured to rod 82. Spring 84′ serves to urge rod 82 and thus rod 84, in the direction 85′ to separate jaw 86 from jaw 94 placing clamp 38 in the unclamp state. Arm 67 is pivotally mounted to frame 48 at pin 108. Lever 76 is disposed in a suitable recess in arm 67. Bell crank 54 and lever 62, being resiliently locked together, serve as a single connecting link between arm 67 and shaft 50 for rotating arm 67 about pin 108. As shaft 50 translates in axial direction 52 to the extended position, crank 54 and lever 62 pivot arm 67 about pin 108 into an upright position.

Figure 6:
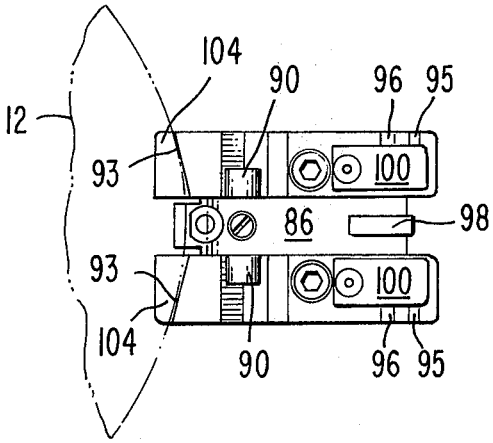
FIG. 6 is a plan view of the clamp of FIG. 5.

Core clamp 38 is shown in more detail in FIG. 5. FIG. 5 illustrates, superimposed, a manual clamp release state (solid) and the clamping state (dotted) for clamp 38. Clamp 38 includes an upper jaw 86 and a lower jaw 94 having respective clamping surfaces 88 and 104 disposed at one end of clamp 38 facing each other. Lower jaw 94 forms a V-notch 93 adjacent surface 104 in plan as shown in FIG. 6. A cylindrical pin 90 is transversely disposed loosely and pivotally in a corresponding aperture 80 in upper jaw 86. Pin 90 extends beyond jaw 86 on opposite sides of jaw 86 as best seen in FIG. 6. Pin 90 mates with a corresponding V-shaped notch 92 in lower clamp jaw 94 when the jaws are in the core clamp state. A second pin 96 depends transversely from jaw 86 and seats in one of two notches 95 in lower jaw 94 which notches determine the manual clamp and unclamp position of jaw 86. Jaw 86 is resiliently secured to jaw 94 at pin 96 by cantilevered spring 100. There are two sets of pins 96 and spring 100 on opposite sides of jaw 86 as seen in FIG. 6. Lever 98 is pivotally mounted to pin 96 and to lower jaw 94 at pivot pin 102 (FIG. 5).

In the manual release position (solid), jaw 86 is forced upwards and to the right in the drawing by the detent action of pin 90 with V-shaped notch 92. Jaws 86 and 94 are placed in the unclamp position either by the action of rods 82 and 84 or by the action of lever 98.

Secured adjacent to clamping surfaces 88 and 104 is locating insert 106 which faces radially inwardly toward core 12. Insert 106 serves to closely receive a corresponding slot (not shown) in core 12. Insert 106 precisely locates the core 12 with respect to clamp 38 in the azimuth direction 30 (FIG. 2). Four slots (not shown) are provided on a core 12 for each of the clamps 32, 34, 36, 38 insert 106. Clamps 32, 34, 36, 38 are preferably spaced about 90° from each other in the azimuth direction. Lower jaw 94 of clamp 38 is secured to support arm 67 and insert 106 is secured to lower jaw 94 by suitable fastening means.

In FIG. 3, the position illustrated is the one in which the upper jaw 86 and the lower jaw 94 are in the closed clamping state. In this state, actuating shaft 50 in FIG. 2 is fully extended, support arm 67 is in the upright clamp position, cam 76 has been activated by leg 56, and rod 84 is retracted in the downward direction 85 by cam 76 through rod 82 and means 83. This action pulls jaw 86 into the downward clamping position.

To unclamp clamp 38 and move arm 67 to the prone position, suitable air pressure is applied to air cylinder 44 in a manner to retract shaft 50 to the right. The initial action causes coil spring 68 to maintain lever 62 against stop 59 as bell crank 54 pivots about pivot pin 57 in response to the retraction of shaft 50. This is a relatively small amount of travel which is limited by the spaced relationship of leg 56 with end portion 66, surface 70. The slight pivot action of crank 54 with respect to lever 62 is sufficient to permit cam 76 to rotate counterclockwise, which, in turn, causes rod 82, in response to the spring 84′, to travel in the upward direction 85′. Rod 82 then abuts rod 84 and those two rods continue the upward motion. This action raises upper jaw 86 and separates upper jaw 86 from lower jaw 94, which releases clamp 38 from core 12. In a continuing motion, shaft 50 is retracted into the body of cylinder 44, abutting leg 56 against surface 70. At this time crank 54 and lever 62 act as a single lever.

In the shaft 50 retracted position the arrangement of the various links is shown in FIG. 7. Shaft 50 and air cylinder 44 rotate slightly about pivot pin 46 during the rotation of arm 67. Levers 58 and 58′ pivot the combined lever formed by crank 54 and lever 62 about pin 57 and pin 60, rotating arm 67 about pin 108, lowering arm 67 an clamp 38 until 67 comes to rest on a suitable cushioned stop 110. During this action coil spring 84′ compressively forces rod 84 in the direction 85′ maintaining the jaws 94 and 86 in the open, unclamped state.

Each assembly 22, 24, 26, 28 is arranged to be adjustably secured in the radial direction 52 (FIG. 3) so as to accommodate cores 12 of different diameters. To accomplish this, screw 99, FIG. 3 secures frame 48 to suitable corresponding slotted support 129 (FIG. 2). Slotted support 129 is secured to support table 131 which is secured to indexing head 20 as described above herein.

To program each of the clamp assemblies in either the upstanding or the downward or prone position, as shown respectively in FIGS. 3 and 7, a preprogramming arrangement is provided. The program of the preprogrammed arrangement is stored in and is part of the punched tape processed by the electronics portion 19 (FIG. 1). The indexing head 20 and base 18 have corresponding indicia 33 and 31, respectively, which indicate and locate the machine start position when the indicia are aligned to synchronize the punched type with the machine position. In FIG. 2, manifold 120 is securely mounted on base 18 and is connected to a source of air pressure, (not shown). The manifold 120 is connected to a plurality of conduits 122 through a plurality of electrically operated valves, (not shown). The valves (not shown) are operated by electrical signals supplied by electronics portion 19 (FIG. 1). The valves (not shown) open or close, as the case may be, selected ones of conduits 122 to the preselected air pressure within manifold 120. The selection of which conduits 122 are open and which are closed to the pressure in manifold 120 is preprogrammed by the punched tape in portion 19 (FIG. 1).

Mounted in a fixed position is cylindrical slip-ring 128. Slip-ring 128 is closely fitted about support head 124 and is fixed in position by a suitable rod (not shown) connected to base 18 via manifold 120. As a result, slip-ring 128 forms a collar which remains in a fixed position as head 124 and flange 20′ rotate. Disposed on the inner wall of slip-ring 128 are a plurality of annular grooves 126, in this case, eight. Grooves 126 extend 360° around the inner periphery of slip-ring 128. The grooves 126 are parallel to each other forming a plurality of parallel annular recessed rings in the inner wall of slip-ring 128. Each groove 126 is connected to manifold 120 through a separate, different conduit 122 and corresponding valve (not shown). This is accomplished by forming a hole through the wall of slip-ring 128 in communication with a selected groove 126 and connecting this hold to manifold 120 by corresponding conduit 122 and valve. Conduits 122 also serve to secure slip-ring 128 in a fixed position in addition to the rod (not shown) connected to manifold 120. Grooves 126 form a slip-ring configuration for high pressure air.

Secured to rotating cylindrical clamp assembly support head 124 is support table 131. Head 124 and flange 20′ are rotatably driven by suitable drive and indexing means (not shown) mounted on base 18. Head 124 is closely received within slip-ring 128 and rotates with respect to slip-ring 128. Disposed on the wall of head 124 are a plurality of apertures 123, in this case, eight, each aperture corresponding to and communicating with a separate, different respective groove 126 throughout a 360° rotation of head 124. Each aperture 123 is in communication with and connected to a separate, different conduit 132 to provide programmed pressurized air to a selected conduit 132. Operation of selected ones of the valves (not shown) by portion 19 selects which conduit 122, and thus conduit 132, is pressurized. Each air cylinder 44 has two conduits 132 connected thereto. One of these two conduits 132 supplies pressurized air for retracting shaft 50 and the other conduit supplies pressurized air for extending shaft 50 (FIG. 3) in the direction 52. Suitable conduits are formed within head 124 and table 131 to interconnect each aperture 123 with a corresponding conduit 132.

The punched tape in electronics portion 19 (FIG. 1) is preprogrammed to open and close selected ones of the valves (not shown). This provides pressurized air to the selected air cylinders 44 to raise or lower the corresponding arm 67 in accordance with the proximity of that arm 67 with the magazine 14, shuttle 16 and frame of the machine 10 (FIG. 2).

Assuming indicia 31 and 33 are at the 0° position, then assembly 26 is positioned approximately in the 180° position as is machine support 42. In this arrangement the preprogram is one which will lower any of the arms 67 of clamping assemblies 22, 24, 26 or 28 when approximately in the 160° to 200° sector. Between 0° and 160° and 200° and 360°, clamping assemblies 22,

24, 26 or 28 are in the raised or upstanding position. The punched tape in electronics portion 19 (FIG. 1) is preprogrammed accordingly. It is also assumed that no machine interference occurs when the clamping machine assemblies are in the 0° to 160° and 200° to 360° sector. Such preparation of a punched tape is widely understood in the current operation of automated machines.

The punched tape in electronics portion 19 supplies the drive signals to the indexing head 20 drive means (not shown) in a conventional manner. The punched tape is a continuous loop which contains all of the information necessary to wind a complete coil about core 12. The information in the tape which determines which of clamping assemblies 22, 24, 26 and 28 are in the upstanding clamp position or downward standby position is preprogrammed into the tape in accordance with the known position of that clamping assembly during the winding process. The start position of the punched tape is manually synchronized with the winding process by the alignment of indicia 31 and 33.

The operation of the machine will now be explained. Assuming no cores 12 are in any of the machines 10, levers 98 are manually pulled radially outwardly so as to cause the upper jaws 86, FIG. 3, to be pulled upwardly and radially outwardly away from the core 12 position. The operator then inserts a core 12 in a core clamp assembly, section 23, FIG. 2. Each of core clamps 32, 34, 36, 38 which are in the preprogrammed upstanding position, as shown in FIG. 2, are placed with their levers 98 in the condition just described. The slots (not shown) in the core 12 are closely received by corresponding inserts 106 (FIG. 5) mounted in the radially inward extending faces of each of the core clamps 32, 34, 36, 38 as described above. Insert 106, when seated in the corresponding groove of the core 12 prevents even the slightest lateral motion of the core 12 when clamped. The clamping surfaces 88 and 104, FIG. 5, protrude radially inwardly, toward core 12, an amount sufficient to grab the peripheral outer edge of lower rim 40 of core 12 (See FIG. 3), which leaves sufficient room for the clamps 32, 34, 36, 38 to grip the lower rim 40 after a coil has been wound at the clamping location without marring or damaging the coil or windings. The clamp does not clamp the core 12 on the coil itself after the coil is wound. A sufficient portion of rim 40 is provided after the coil is wound thereon such that the core 12 may be securely clamped without interfering with the coil whether or not it is wound or in the process of being wound.

When the core 12 is inserted and seated on clamping surface 104 of each of the clamps, the levers 98 are each manually returned to the forward or radial inward position until pins 90 seat in the notches 92 as best seen in FIG. 5. At this point, the operator is ready to start winding of the coil. The program is taped on a continuous tape, preferably an endless punched tape. The punched tape is synchronized with the position of the core clamping portion 23. This is accomplished by aligning indicia 31 and 33, while aligning the punched tape (not shown) in electronics portion 19 in a start position.

The operator then closes a start switch (not shown) on control panel 25 corresponding to that machine 10 in which the core 12 was just installed. That machine 10 then proceeds to wind the coil about the core 12 independently of the operation of the remaining machines 10. The operator closes a second control switch (not shown) on panel 25 and causes the turntable 15 to index the next machine desired in the direction 17 in front of the operator. The operator installs the second core on that machine. In this manner each of the machines 10 on turntable 15 are caused to wind a toroidal coil in a corresponding deflection yoke core 12. When the last machine 10 to have a core installed by the operator in the initial sequence is operating, the operator closes a switch on panel 25 causing suitable controls to place the turntable 15 in the automatic mode. In the automatic mode turntable 15 is caused by suitable controls (not shown) to rotate the first set up machine 10 in front of the operator.

Control panel 25 is coupled to a suitable control electronics (not shown) which controls the rate of rotation of the turntable 15 in accordance with the type and size of the coil to be wound on the cores 12. With a large coil, turntable 15 is caused to rotate at a rate so that the timing of the rotation corresponds to the timing of the coil winding operation to position a coil in front of the operator at the time the coil winding operation is completed.

In the alternative, suitable control electronics may be provided for indexing the turntable on an intermittent basis rather than on a continuous rotation. In the indexing mode, each coil winding machine 10 is indexed to position the operating station adjacent the operator. When a predetermined coil winding operation is completed, the operator removes the wound core and replaces it with a new core. The machine then automatically indexes the next work station adjacent the operator. Further, upon activation of a suitable control, the operator overrides the automatic timing machine to semi-manually index the machine.

During the winding operation, indexing head 20 of FIG. 2 rotates the core clamping section 23 about the interlinked shuttle 16 and magazine 14 generally in the horizontal or transverse plane. As each of the clamps 32, 34, 36, 38 and the corresponding support arms 67 approach extended support 42, magazine 14, or shuttle 16 and other parts of machine 10, certain of the valves (not shown) open selected ones of conduits 122 to the corresponding grooves 126 to pressurized air. This activates the associated air cylinder 44 corresponding to that clamping assembly. The air cylinder shaft 50, see FIG. 7, retracts radially outwardly in direction 52 away from the center of the axis of rotation of indexing head 20. This action pulls only crank 54 initially since spring 68 initially forces lever 62 against adjustable stop 57. This action releases spring 84′ which urges rod 84, and thus upper jaw 86, upwardly an amount sufficient to unclamp core 12 at lower rim 40. The continuous motion of shaft 50 of air cylinder 44 continues to retract and at this time pulls in unison crank 54 and lever 62 which are now abutting at surface 70 as a single lever in rotation about pin 57. This rotation is counterclockwise in FIG. 3. The counterclockwise rotation causes lever 62 to rotate support arm 67 about pin 108 in a clockwise direction into the lowered or standby position as illustrated in FIG. 7 in conjunction with the action of levers 58 and 58′ rotating about pin 60. When in this position arm 67 and clamp 38 of FIG. 7 correspond to the position of clamping assembly 26 of FIG. 2.

At the same time, the tape control of machine 10, FIG. 2, rotates indexing head 20 and clamping assembly section 23 in either the clockwise or counterclockwise direction in accordance with the type of coil being wound, permitting the strands of the filament to be wound adjacent to the areas at which the core clamp 12 is to be or has been clamped. Regardless of the type of coil, each clamping assembly 22, 24, 26, 28 is automatically lowered or raised in place in accordance with its angular orientation with resepct to support 42.

There has thus been shown a machine constructed and operated in accordance with the present invention which can quickly, easily and automatically clamp and unclamp a core about which a toroidal coil is to be wound.

What is claimed is:

1. In a coil winding machine for winding a coil about a hollow core, the combination comprising:

a base, a rotating indexing head mounted on said base, annular coil winding means mounted in a given position on said base for engaging said core in interlinked spaced relationship during said winding, a plurality of core clamps mounted on said indexing head, said head and clamps rotatably securing said core to said base, and means including clamp actuating means coupled to said clamps and responsive to the indexed position of said head for automatically causing selected ones of said clamps to clamp said core in accordance with the angular position of each of said clamps with respect to said coil winding means.

2. The combination of claim 1 wherein said coil winding means includes an annular coil winding shuttle and an annular filament storing magazine roatatably mounted on said base.

3. In a coil winding machine for winding a coil about a hollow core, the combination comprising:

a base, a rotating indexing head mounted on said base, annular coil winding means mounted in a given position on said base for engaging said core in interlinked space relationship during said winding, a plurality of core clamps mounted on said indexing head, said head and clamps rotatably securing said core to said base, said clamps each including first and second jaws having clamp and unclamp states. pivot means connected to said jaws for pivotally mounting said first and second jaws to said head and for disposing said jaws either in an upstanding clamping position or in a prone standby position, said pivot means further including jaw operating means for causing said jaws to sequentially assume the clamp state after said clamp jaws are disposed in said upstanding position, means including clamp actuating means coupled to said clamps for automatically causing selected ones of said clamps to clamp said core in accordance with the angular position of each of said clamps with respect to said coil winding means, and means for coupling said automatic means to said pivot means.

4. In a coil winding machine for winding a coil about a hollow core, the combination comprising:

a base, a rotating indexing head mounted on said base, annular coil winding means mounted in a given position on said base for engaging said core in interlinked spaced relationship during said winding, a plurality of core clamps mounted on said indexing head, said head and clamps rotatably securing said core to said base, and means including clamp actuating means coupled to said clamps for automatically causing selected ones of said clamps to clamp said core, said automatic means including control means synchronized with the rotation of said clamps for automatically causing said winding means to wind said coil and a selected clamp to clamp and unclamp said core in accordance with the angular position of that selected clamp.

5. In a toroidal coil winding machine for winding a toroidal coil about a television deflection yoke core, the combination comprising:

a base, annular coil winding means mounted on said base, indexing means mounted on said base for rotatably positioning said core with respect to said coil winding means, a plurality of spaced core clamps pivotally secured to said indexing means, said clamps each including means for disposing that clamp either in an upstanding clamp position or prone unclamped standby position with respect to said base, said clamps securing said core interlinked with said coil winding means when in said upstanding position, and means coupled to said core clamps for automatically selectively causing certain of said clamps to clamp said core while automatically positioning a selected clamp in said prone unclamped position in accordance with the indexed position of said clamps.

6. The combination of claim 5 wherein said automatic means includes position determining means coupled to said indexing means for determining the angular position of said indexing means and for generating a position signal manifesting said determined angular position, said clamp disposing means including clamp position means responsive to said signal applied thereto for disposing said clamps in either said upstanding position or said prone position in accordance with the angular position manifested by said signal.

7. The combination of claim 6 wherein said clamps include means for causing said upstanding clamps to sequentially assume a clamped condition with said core after being disposed in said upstanding position, and for causing said upstanding clamp to assume an unclamp condition with said core prior to being disposed in said prone position.

8. A method of winding a toroidal coil about a hollow frusto-conical television tube deflection yoke core of the type having a pair of spaced planar annular rims comprising:

clamping said core by a plurality of clamps at a plurality of spaced locations on at least one of said rims, winding a toroidal coil about said core with coil winding means interlinked with said core, automatically determining the position of said core with respect to said winding means, and automatically unclamping and then retracting one of said clamps at one of said locations from said core and into a clamp standby position in accordance with the determined core position.

9. The method of claim 8 further including the steps of returning said retracted clamp to a core clamping position and then clamping said core with the returned clamp in response to the determined core position.

10. The method of claim 8 wherein said clamping step includes the step of clamping at solely one of said rims at the outer peripheral edge thereof.

11. In combination:

a base, means for rotating said base, and a plurality of coil winding machines mounted on said base for simultaneously winding toroidal coils about a like plurality of fustro-conical television picture tube deflection yoke cores, said winding machines each including automatic core clamping means arranged to automatically clamp and unclamp said core during aid winding, said clamping means including a plurality of core clamps for separately and independently gripping said core.

12. The combination of claim 11 wherein said winding machines each include core position determining means mounted on said machines for determining the angular position of that core secured to the corresponding machine, and means responsive to said determining means for causing said clamps to assume either a clamp condition or an unclamp condition in accordance with the core position determined.

13. A clamp for clamping a fustro-conical television tube deflection yoke core comprising:

a frame reciprocating actuating means privotally mounted to said frame, a core clamp including a pair of clamping jaws pivotally mounted to said frame, link means pivotally connected to said frame, clamp and said actuating means for rotating said clamp between first and second positions, and cam means connected to one of said jaws and operated by said actuating means so that said jaws can assume either a clamp or unclamp state when said clamp is in said first position.

14. In combination, a base, an indexing means mounted for rotation on said base, a plurality of clamping means mounted on said indexing means for rotation with said indexing means with said clamping means spaced from one another to hold an object therebetween, said clamping means being pivotally mounted to said indexing means so that each clamping means can be unclamped from said object and moved away from said object independently of the position of said other clamping means, and means for automatically causing selected ones of said clamping means to be positioned in clamping position with said object while another of said clamping means is pivoted into an unclamped position away from said object in accordance with the angular position of said indexing means.

* * * * *